US009570858B2

(12) United States Patent
Toda

(10) Patent No.: US 9,570,858 B2
(45) Date of Patent: Feb. 14, 2017

(54) CONNECTOR AND SIGNAL TRANSMISSION METHOD USING SAME

(71) Applicant: Japan Aviation Electronics Industry, Limited, Tokyo (JP)

(72) Inventor: Kentaro Toda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/025,669

(22) PCT Filed: Sep. 12, 2014

(86) PCT No.: PCT/JP2014/074186
§ 371 (c)(1),
(2) Date: Mar. 30, 2016

(87) PCT Pub. No.: WO2015/068467
PCT Pub. Date: May 14, 2015

(65) Prior Publication Data

US 2016/0254619 A1 Sep. 1, 2016

(30) Foreign Application Priority Data

Nov. 8, 2013 (JP) ..... 2013-232112

(51) Int. Cl.

| | |
|---|---|
| ***H01R 13/6471*** | (2011.01) |
| ***H01R 12/58*** | (2011.01) |
| ***H01R 12/71*** | (2011.01) |
| ***H01R 13/6467*** | (2011.01) |
| *H01R 13/6473* | (2011.01) |
| *H01R 24/60* | (2011.01) |
| *H01R 107/00* | (2006.01) |

(52) U.S. Cl.
CPC ..... *H01R 13/6471* (2013.01); *H01R 12/585* (2013.01); *H01R 12/716* (2013.01); *H01R 13/6467* (2013.01); *H01R 13/6473* (2013.01); *H01R 24/60* (2013.01); *H01R 2107/00* (2013.01)

(58) Field of Classification Search
CPC ..... H01R 13/724; H01R 23/7073
USPC ..... 439/79
See application file for complete search history.

(56) References Cited

U.S. PATENT DOCUMENTS 8,864,501 B2 * 10/2014 Lin ..... H01R 13/65807 439/607.4
8,951,050 B2 * 2/2015 Shiratori ..... H01R 13/6471 439/660

(Continued)

FOREIGN PATENT DOCUMENTS

JP 2007-115707 A 5/2007
JP 3134262 U 8/2007

(Continued)

OTHER PUBLICATIONS

International Search Report of PCT/JP2014/074186, mailed Nov. 11, 2014.

(Continued)

*Primary Examiner* — Phuong Dinh
(74) *Attorney, Agent, or Firm* — Collard & Roe, P.C.

(57) ABSTRACT

Provided is a connector, including a plurality of contacts including both of ground contacts and signal contacts forming a differential signal pair. The impedance between the signal contacts and the ground contacts is matched.

13 Claims, 24 Drawing Sheets

(56) References Cited

U.S. PATENT DOCUMENTS

| | | | | |
|---|---|---|---|---|
| 9,136,623 | B2 * | 9/2015 | Hamada | H01R 12/724 |
| 2008/0014803 | A1 | 1/2008 | Kato et al. | |
| 2009/0068963 | A1 | 3/2009 | Cabnillas et al. | |
| 2011/0201215 | A1 | 8/2011 | Matsubara et al. | |
| 2012/0214351 | A1 | 8/2012 | Shiratori et al. | |

FOREIGN PATENT DOCUMENTS

| | | | |
|---|---|---|---|
| JP | 4439540 | B2 | 3/2010 |
| JP | 4638960 | B1 | 2/2011 |
| JP | 2013-084468 | A | 5/2013 |
| TW | I380605 | B | 12/2012 |

OTHER PUBLICATIONS

Taiwan Office Action in TW 103133848 dated Oct. 24, 2016, with translation of relevant part.

* cited by examiner

CONNECTOR AND SIGNAL TRANSMISSION METHOD USING SAME

This application is the National Stage of PCT/JP2014/074186 filed on Sep. 12, 2014, which claims priority under 35 U.S.C. §119 of Japanese Application No. 2013-232112 filed on Nov. 8, 2013, the disclosure of which is incorporated by reference. The international application under PCT article 21(2) was not published in English.

TECHNICAL FIELD

This invention relates to a connector and a signal transmission method using the same. More particularly, this invention relates to a differential signal connector to be used for connection of lines configured to transmit a differential signal pair, and to a signal transmission method using this differential signal connector.

BACKGROUND ART

There is known a differential transmission system configured to transmit a differential signal pair including opposite-phase signals respectively to two signal lines forming a pair. This differential transmission system has a feature in that the data transmission speed can be increased, and hence is practically used in various fields in recent years.

For example, when the differential transmission system is used for data transmission between an apparatus and a liquid crystal display, the apparatus and the liquid crystal display each include a DisplayPort connector designed in conformity with the DisplayPort standard. As the DisplayPort standard, there are known Video Electronics Standard Association (VESA) DisplayPort standard 1.0 and Version 1.1a thereof.

This DisplayPort connector is one type of a differential signal connector, and has a first connection side configured to connect to a connection counterpart, and a second connection side configured to connect to a printed board of the apparatus or the liquid crystal display. The form of the first connection side is strictly determined by the DisplayPort standard due to the relationship with the connection counterpart, but the form of the second connection side is relatively free. This type of differential signal connector is disclosed in Patent Document 1.

The connector of Patent Document 1 includes, as illustrated in FIG. 26, two sets of signal contacts 121 arranged in pairs as a lower contact group constructing the connector, and ground contacts 122 arranged on both sides of each set of the signal contacts 121.

Further, on the first connection side, as illustrated in FIG. 26, contact portions 121*a* of the signal contacts 121 and contact portions 122*a* of the ground contacts 122 are arranged in a row at predetermined intervals D1.

On the other hand, on the second connection side, as illustrated in FIG. 26, terminal portions 121*b* of the signal contacts 121 are arranged in a first row R1, and terminal portions 122*b* of the ground contacts 122 are shifted to be arranged in a second row R2.

With this arrangement, an interval D2 between the terminal portions 121*b* and 122*b* is larger than the interval D1 between the contact portions 121*a* and 122*a*. Thus, while downsizing the connector, it is intended to secure the mountability of the terminal portions 121*b* and 122*b* into through holes (not shown) requiring a certain size and arrangement at certain interval.

PRIOR ART DOCUMENTS

Patent Document

Patent Document 1: Japanese Patent No. 4439540

Patent Document 2: Japanese Utility Model Registration No. 3134262, paragraph 0038, FIG. 5

DISCLOSURE OF THE INVENTION

Problem to be Solved by the Invention

Incidentally, in the connector disclosed in Patent Document 1, although the impedance between the signal contacts 121 is matched to have a satisfactory reflection characteristic, there has been a problem in that transmission failure occurs in signal transmission at a speed higher than that in the related art (for example, transmission of 10 GBPS or higher-speed signals containing a frequency component at which it is considered to be appropriate to treat a connector and a contact as a distributed constant circuit).

This invention has been made in view of such circumstances, and an object to be achieved by this invention resides in suppressing transmission failure that occurs even though impedance is matched between the signal contacts and a satisfactory reflection characteristic is obtained.

To solve the above mentioned objection, this invention provides a connector as an aspect, comprising:

- at least one set of lanes each comprising a plurality of contacts including both of ground contacts and signal contacts forming a differential signal pair; and
- a support portion configured to support the plurality of contacts, the connector being configured to be fixed to a fixing object and removably mounted to a connection counterpart,
- the plurality of contacts forming the one set of lanes each comprising:
  - an end portion on the connection counterpart side;
  - a first linear portion supported by the support portion so as to be parallel to a first, direction that is a mounting/removing direction with respect to the connection counterpart, and so that an equal pitch is secured between adjacent contacts;
  - a first bent portion obtained by bending, at a virtual straight line orthogonal to the first direction as a bending line, the plurality of contacts in a second direction different from the first direction;
  - a second linear portion extending in the second direction while maintaining the equal pitch;
  - a second bent portion obtained by bending at least a part of the plurality of contacts so as to increase a pitch between adjacent contacts; and
  - an end portion on the fixing object side that is formed ahead of the increased pitch,
- the at least one set of lanes each comprising, as pairs of contacts adjacent to each other, both of a pair in which a pitch at the end portion on the fixing object side has a first pitch length and a pair in which the pitch at the end portion on the fixing object side has a second pitch length that is larger than the first pitch length.

Preferably, the one set of lanes comprises even number contacts of 4 or more, and

- the contacts belonging to the one set of lanes are line symmetric with respect to, as an axis, a virtual straight line taken between the first linear portions of two center contacts, and are line symmetric with respect to, as an axis, a virtual straight line taken between the second linear portions, the second bent portions, and the end portions on the fixing object side of the two center contacts.

When four continuous and adjacent contacts belonging to the one set of lanes are sequentially referred to as Ca, Cb, Cc, and Cd, when a pitch of the end portions on the fixing object side between the contact Cb and the contact Cc is referred to as Pin, and when a pitch of the end portions on the fixing object side between the contact Ca and the contact Cb and a pitch of the end portions on the fixing object side between the contact Cc and the contact Cd are both referred to as Pout, the pitch Pin may have the first pitch length, and the pitch Pout may have the second pitch length.

The equal pitch of the first linear portion may be smaller than the first pitch length.

The first pitch length may be a minimum pitch defined based on a limitation in terms of solder mounting technology.

It can be considered that the connector further comprises a contact independent from the one set of lanes, the independent contact comprises at least the first linear portion and the first bent portion, and the bending line of the first bent portion in the one set of lanes and the bending line of the first bent portion in the independent contact are located on two different straight lines that are parallel to each other.

The at least one set of lanes comprises a plurality of lanes may comprises a first lane and a second lane, the support portion may be configured to support the first lane and the second lane so as to be arrayed, and the bending line of the first bent portion in the first lane and the bending line of the first bent portion in the second lane may be located on two different straight lines that are parallel to each other.

In that case, preferably, as viewed from the first direction, the second bent portion of the first lane and the second bent portion of the second lane appear to be overlapped with each other at least in part, or appear to intersect with each other.

And in that case, preferably, the at least one set of lanes comprises a plurality of lanes comprising a first lane, a second lane, . . . , and an n-th lane, where n represents a natural number of 3 or more, the support portion is configured to support the plurality of lanes so as to be arrayed, and the bending line of the first bent portion in odd lanes comprising the first lane, the third lane, . . . , and the (2m−1)th lane, where m is a natural number, and the bending line of the first bent portion in even lanes comprising the second lane, the fourth lane, . . . , and the 2m-th lane, where m is a natural number, are located on two different straight lines that are parallel to each other.

This invention provides a connector as another aspect, comprising: a plurality of contacts comprising both of ground contacts and signal contacts forming a differential signal pair, wherein impedance is matched between the ground contacts and the signal contacts.

Furthermore, this invention provides a board on which the aforementioned connector is to be mounted, the board comprising a plurality of through holes configured to insert therein contacts belonging to the one set of lanes, wherein a pitch between the plurality of through holes comprises at least the first pitch length and the second pitch length.

Preferably, two of the plurality of through holes having the first pitch length comprise oval lands.

This invention provides a signal transmission method as another aspect, comprising mounting the aforementioned connector to a fixing object to transmit differential signals.

Effect of the Invention

According to the one embodiment of this invention, it is possible to suppress the transmission failure that has occurred in the case of signal transmission at a speed higher than that in the related art even though impedance is matched between the signal contacts and a satisfactory reflection characteristic is obtained.

MODE(S) FOR EMBODYING THE INVENTION

A connector 1 according to one embodiment of this invention is described. The connector 1 is a connector to be used for connection of lines configured to transmit a differential signal pair. The connector 1 is mounted to a fixing object such as a connector mounting board 2, and is removably connected to a counterpart connector (not shown) serving as a connection counterpart.

Figure 1:
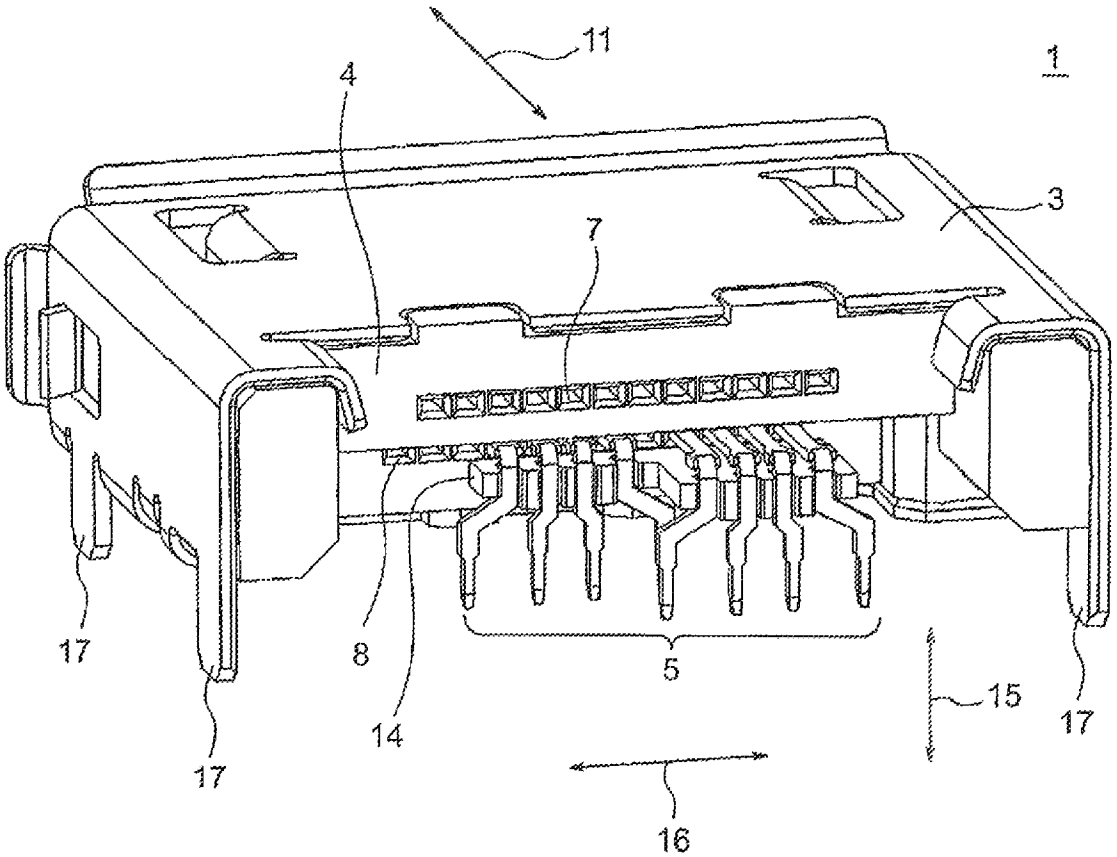
FIG. 1 is a perspective view of a connector 1 according to a first embodiment of this invention.
Figure 2:
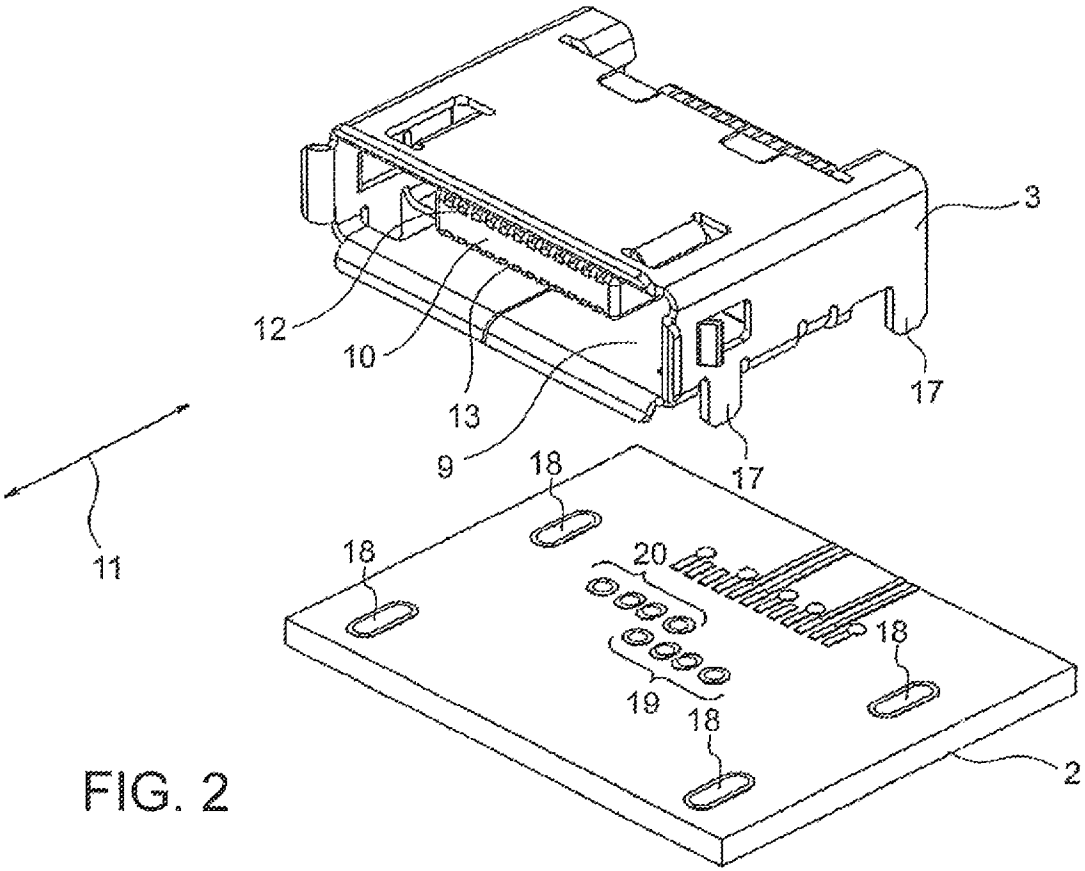
FIG. 2 is a perspective view of the connector 1 and a board 2 on which the connector 1 is mounted.
Figure 3:
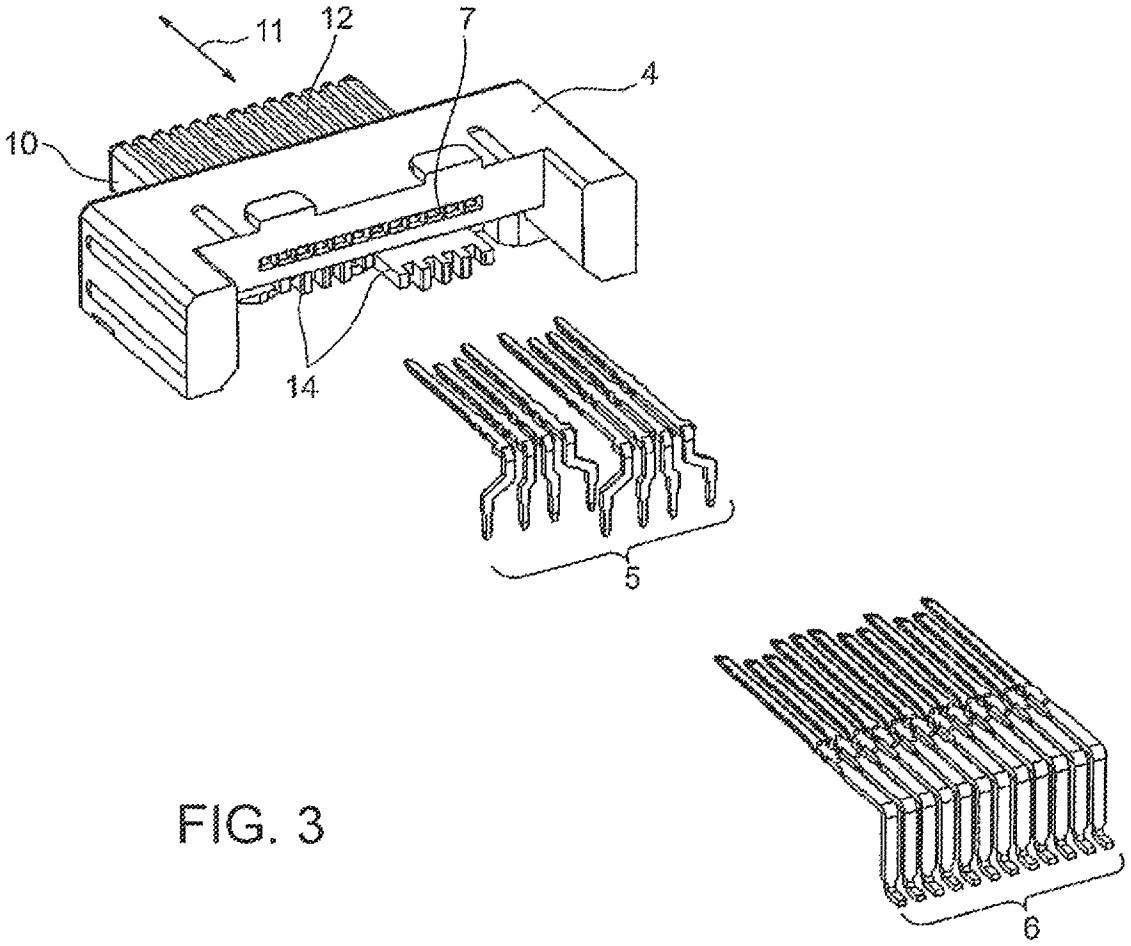
FIG. 3 is an exploded perspective view for illustrating contacts 5 and 6 to be supported by a housing 4.

Referring to FIG. 1, FIG. 2, and FIG. 3, the connector 1 includes a shell 3 and a housing 4. The housing 4 is configured to support a contact 5 and a contact 6, and has openings 7 and 8 configured to lead out those supported contacts. Inside an opening portion 9 of the shelf the housing 4 includes a support plate 10. The support plate 10 has a substantially rectangular plate shape, and in an upper surface thereof, upper grooves 12 configured to support the contact 6 are formed along a direction indicated by the arrow 11 in the figures, that is, a mounting/removing direction 11 between the connector 1 and the counterpart connector (not shown). Similarly, in a lower surface of the support plate 10, lower grooves 13 configured to support the contact 5 are formed along the mounting/removing direction 11.

The contact 6 supported by the upper grooves 12 is led out from the opening 7. On the other hand, the contact 5 supported by the lower grooves 13 is led out from the opening 8, and then guided in a direction of the arrow 15 along grooves formed in a side surface of a support plate 14 extending from a lower end of the opening 8. In the following, the direction indicated by the arrow 15 is referred to as "board direction". The mounting/removing direction 11 and the board direction 15 are orthogonal to each other. A direction orthogonal to both of the mounting/removing direction 11 and the board direction 15 is referred to as "width direction 16". In FIG. 1, illustration of the contact 6 is omitted so as to prevent the shape of the contact 5, which is important in this invention, from being hidden.

The shell 3 includes, at four corners thereof, leg portions 17 projecting toward the board direction 15. As illustrated in FIG. 2, the connector 1 is mounted on the board 2, and the board 2 has holes 18 formed therein so as to insert the respective leg portions 17 therein. Further, the board 2 has through hole rows 19 and 20 formed therein so as to insert the contact 5 therein.

Figure 4:
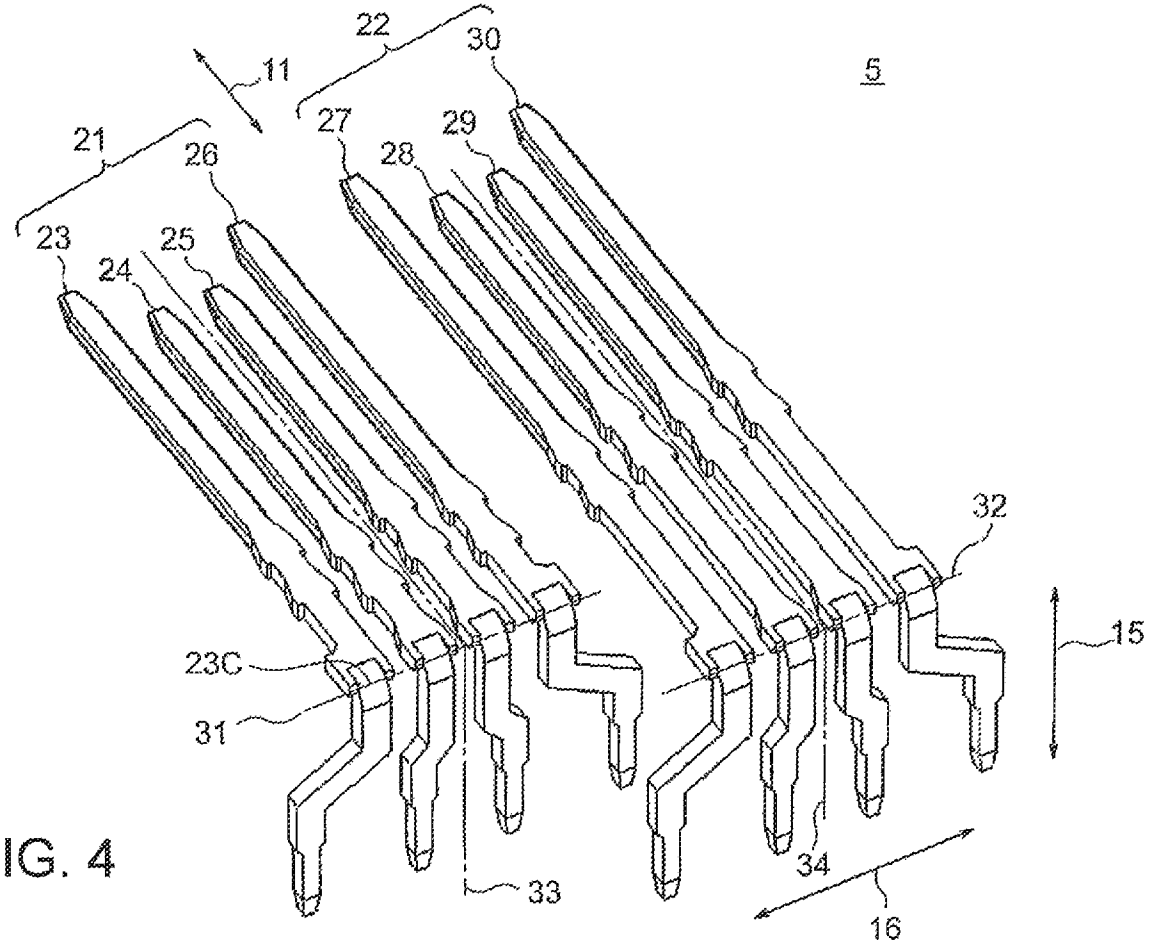
FIG. 4 is a perspective view for illustrating the contact 5 in a state of being assembled to the connector 1, in particular, a positional relationship of each contact constructing the contact 5.

Referring to FIG. 4, the contact 5 is further described. The contact 5 includes two lanes 21 and 22. The lanes 21 and 22 are both lanes for high-speed differential signals. The lane 21 corresponds to the through hole row 19, and the lane 22 corresponds to the through hole row 20. Contacts in the lane 21 are a ground contact 23, a signal contact 24, a signal contact 25, and a ground contact 26 in the order from the left side in FIG. 4. Similarly, contacts in the lane 22 are a ground contact 27, a signal contact 28, a signal contact 29, and a ground contact 30.

The positional relationship among the signal contacts 24, 25, 28, and 29 and the ground contacts 23, 26, 27, and 30 illustrated in FIG. 4 is the same as the positional relationship when the contacts are supported by the lower grooves 13 of the support plate 10. In other words, FIG. 4 is an illustration of a state in which each portion other than the contacts is made invisible in FIG. 1.

Figure 5:
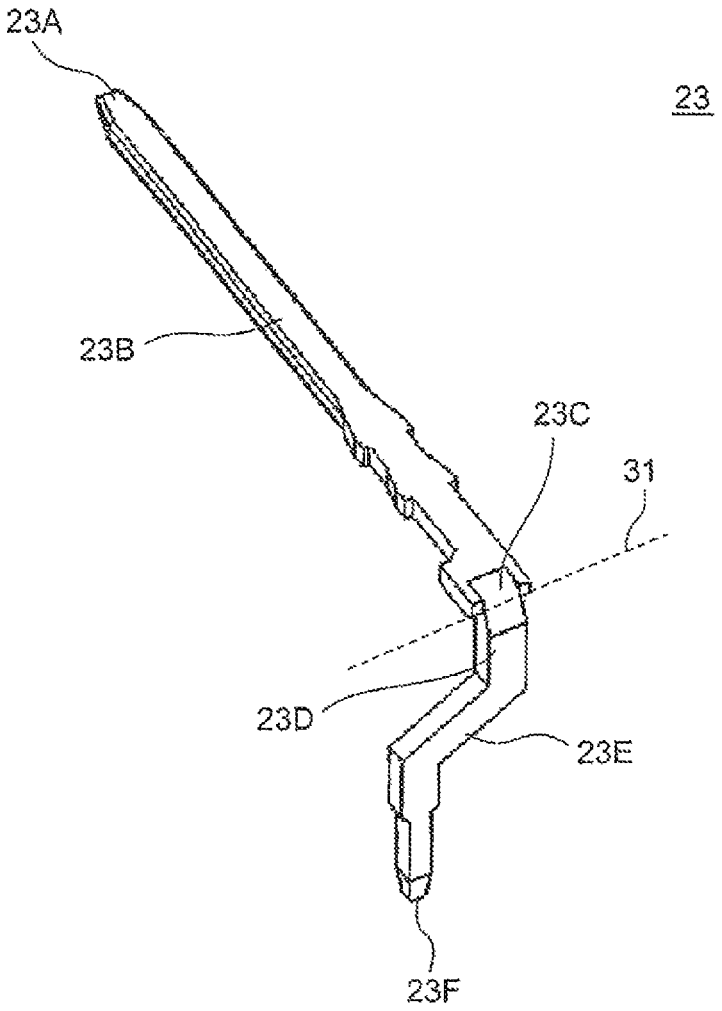
FIG. 5 is a perspective view of a ground contact 23.
Figure 6:
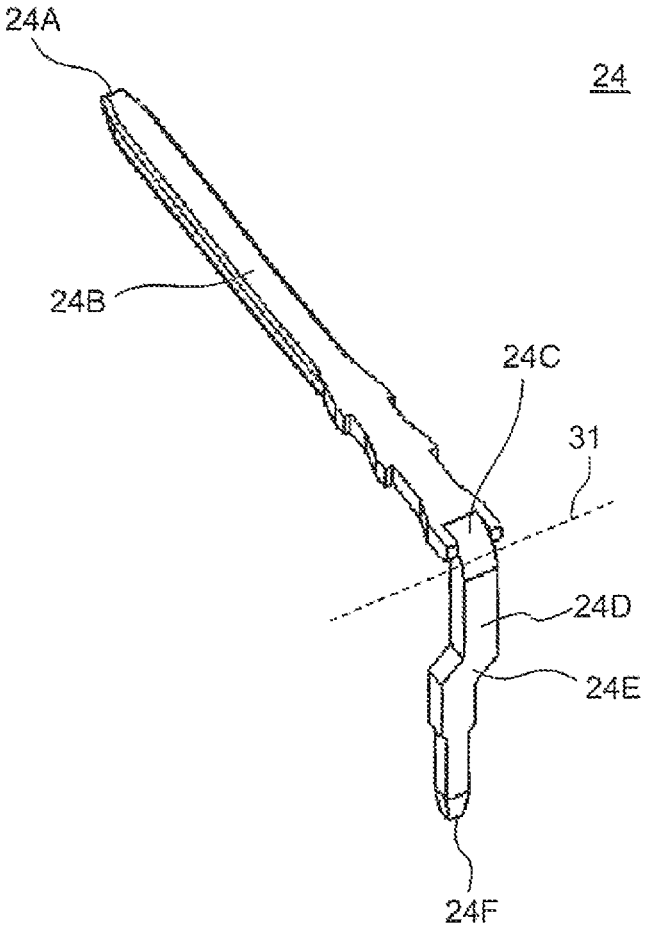
FIG. 6 is a perspective view of a signal contact 24.

Each of the contacts of the lanes 21 and 22 includes a counterpart connector-side end portion, a first linear portion, a first bent portion, a second linear portion, a second bent portion, and a board-side end portion. The shape of each contact is described with reference to FIG. 5 taking the ground contact 23 of the lane 21 as an example. A counterpart connector-side end portion 23A is an end portion located on the counterpart connector (not shown) side to be mounted on or removed from the connector 1 in the mounting/removing direction 11. A first linear portion 23B is a part which is supported by the lower groove 13 of the support plate 10 along the mounting/removing direction 11, and passes through the upper surface of the support plate 14. A first bent portion 23C is a part that is bent in the board direction 15 at the end portion of the support plate 14, that is, at a bending line 31. A second linear portion 23D is a part which is supported by the side surface of the support plate 14, and extends toward the board direction 15. A second bent portion 23E is a part which is bent in the width direction 16 so as to be distant from the center line, and is then bent in the board direction 15. A board-side end portion 23F is a part that passes through the through hole row 19 to be soldered onto the board 2. As is understood in view of FIG. 6, the similar description applies also to the signal contact 24.

As is understood in view of FIG. 4, the lane 21 is line symmetric with respect to, as an axis, a center line 33 between the signal contacts 24 and 25. The difference between the signal contacts 24 and 25 only resides in the bending directions of the second bent portion 24E of the signal contact 24 and the second bent portion 25E of the corresponding signal contact 25 (reference symbols are not shown), and the bending directions are opposite to each other in the width direction 16. Similarly, the difference between the ground contacts 23 and 26 only resides in the bending directions of the second bent portion 23E of the ground contact 23 and the second bent portion 26E of the corresponding ground contact 26 (reference symbols are not shown), and the bending directions are opposite to each other in the width direction 16.

Figure 7:
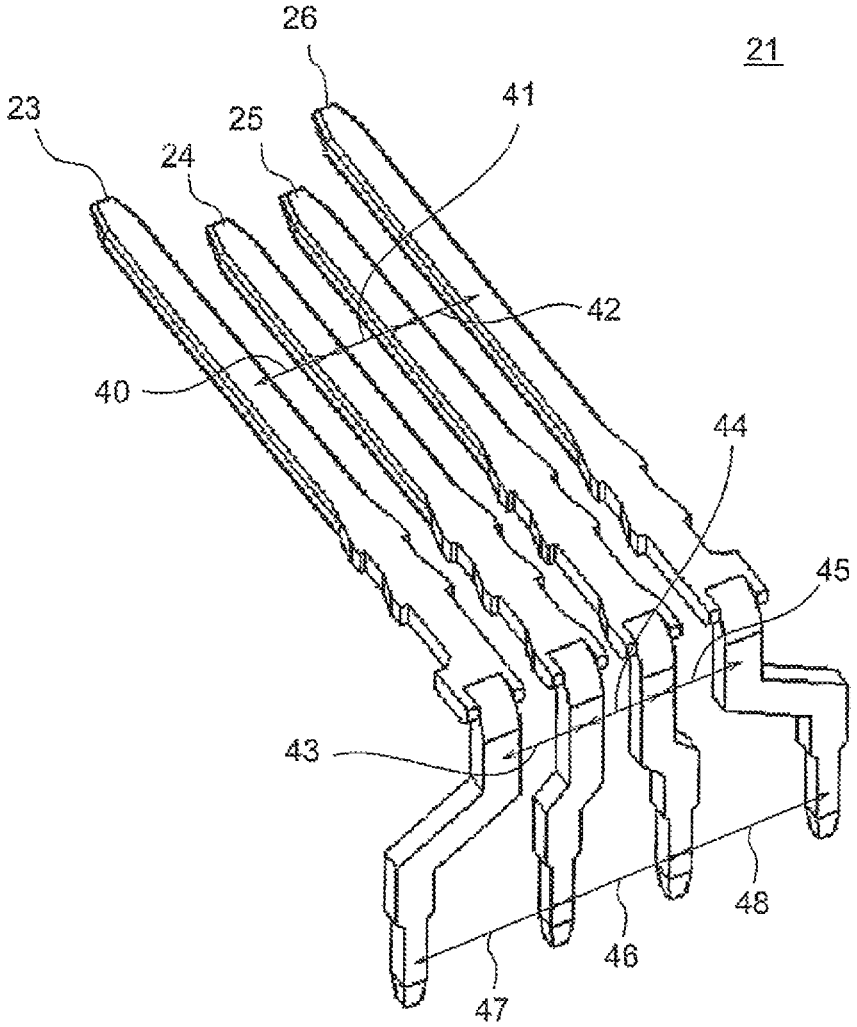
FIG. 7 is a perspective view for illustrating pitches between the contacts in a lane 21 of the contact 5.

The change in pitch between the contacts in the lane 21 is described referring to FIG. 7. The pitches of the first linear portions are all the same. In this case, the pitch length of each of pitches 40, 41, and 42 is represented by P1. The pitches of the second linear portions directly maintain the pitch lengths P1 in the first linear portions, and the length of each of pitches 43, 44, and 45 is P1. However, the pitches of the board-side end portions are varied between the center portion and both sides thereof. A pitch 46 between the signal contacts 24 and 25 is larger than the pitch length P1. The pitch length of the pitch 46 is represented by P2. Further, a pitch 47 between the signal contact 24 and the ground contact 23 and a pitch 48 between the signal contact 25 and the ground contact 26 are equal to each other, and are larger than both of the pitch lengths P1 and P2. The pitch length of each of the pitches 47 and 48 is represented by P3. When the pitch lengths are compared to each other, a relationship of P1<P2<P3 is obtained.

In other words, in the lane 21, in a range from the counterpart connector-side end portion through the first bent portion to the first linear portion, the pitch length P1 is maintained. By maintaining the pitch length P1 even beyond the first bent portion, the impedance matching can be easily achieved between the signal contacts 24 and 25 and the ground contacts 23 and 26. Further, each contact is bent at the second bent portion toward the outer side in the width direction 16. At this time, the signal contacts 24 and 25 arranged on the innermost side are bent so that the pitch 46 therebetween is enlarged to achieve the pitch length P2>P1. On the other hand, the ground contacts 23 and 26 arranged on the outer sides of those contacts are bent so that the pitches 47 and 48 with the contacts on the inner side thereof are set to the pitch length P3>P2.

In order to narrow the connector 1, the pitch length P1 in the first linear portion is preferred to be as narrow as possible. However, from the limitation in terms of solder mounting technology, the minimum pitch length at which soldering is possible on the board is determined. Therefore, the pitch of the through hole row 19 cannot be reduced to be smaller than the minimum pitch length.

Further, it is possible to solder two points on the board at the minimum pitch length, but it is technically difficult to solder a point adjacent to those points at the minimum pitch length. It is assumed that there are two points A and B that are soldered on the board at the minimum pitch length. At this time, when a different point C adjacent to the point A in a direction opposite to the point B is further soldered, the pitch between the point A and the point C is required to be larger to some extent than the minimum pitch length.

In view of those points, the pitch between the two contacts located on the inner side in the lane 21 is set to the minimum pitch length P2 at which the solder mounting is possible, and the pitch between the contacts adjacent thereto on the outer side is set to the pitch length P3 that is larger than the minimum pitch length P2. As a result, the width as the entire through hole row 19 can be narrowed.

The description above of the lane 21 may be applied also to the lane 22. However, the lanes 21 and 22 are different in length of the first linear portion between the corresponding contacts. As illustrated in FIG. 4, the contact in the lane 22 is longer in all of the contacts. Due to this difference in length, the corresponding through hole rows of the lane 21 and the lane 22 are not aligned on the same straight line, but are aligned on two straight lines parallel to each other.

Figure 8:
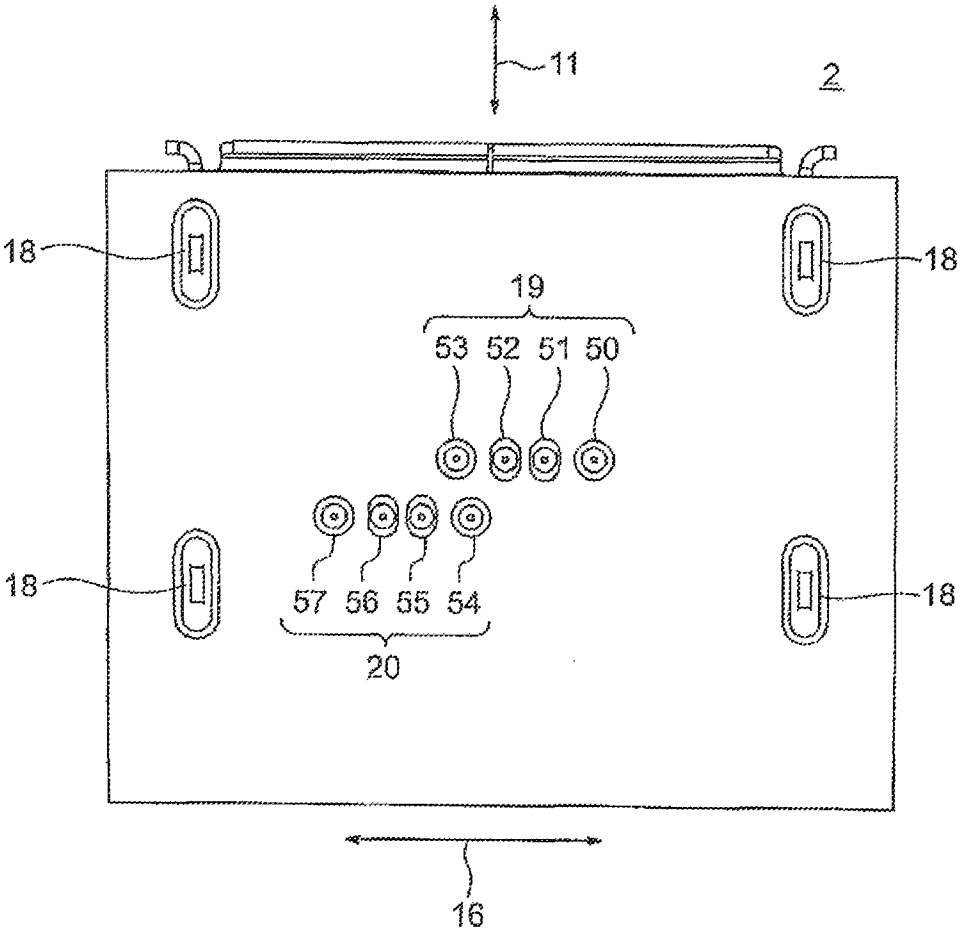
FIG. 8 is a view for illustrating a solder side of the board 2.

Referring to FIG. 8, the solder side of the board 2 is described. The through hole row 19 that includes four through holes 50 to 53 corresponding to the four contacts 23 to 26 of the lane 21, is provided. The through holes 50 to 53 correspond to the ground contact 23, the signal contacts 24 and 25, and the ground contact 26 in the stated order. Similarly, the through hole row 20 that includes four through holes 54 to 57 corresponding to the four contacts 27 to 30 of the lane 22, is provided. The through holes 54 to 57 correspond to the ground contact 27, the signal contacts 28 and 29, and the ground contact 30 in the stated order. The through hole row 19 and the through hole row 20 form two parallel straight lines different from each other.

Figure 9:
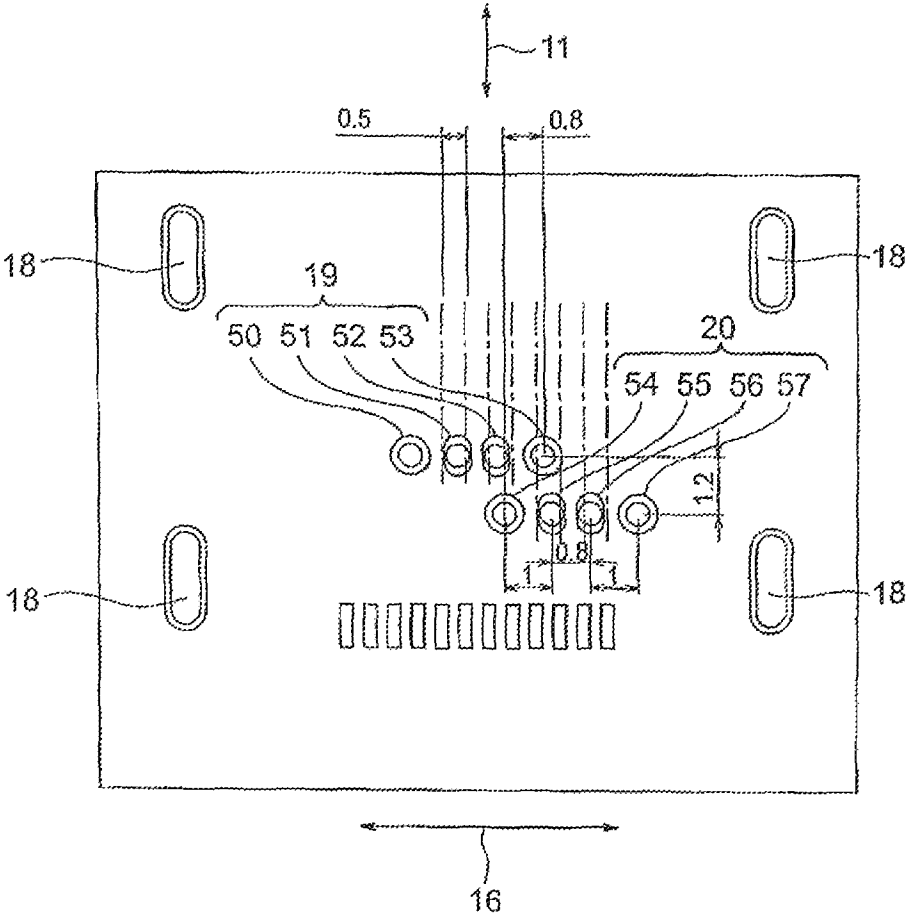
FIG. 9 is a view of a component side for illustrating a dimension example of through hole rows 19 and 20 of the board 2.

As described above, the pitch length P2 between the signal contacts 24 and 25 of the lane 21 is the minimum pitch length at which the solder mounting is possible. In this embodiment, in order to realize the minimum pitch length, as illustrated in the figure, lands of the through holes 51 and 52 corresponding to the signal contacts 24 and 25 are formed as oval lands, to thereby narrow the pitch. On the other hand, as lands of the through holes 50 and 53 corresponding to the ground contacts 23 and 26, circular lands are used. Lands of the through hole row 20 corresponding to the lane 22 are similar thereto. An example of the actual dimension of the board 2 of FIG. 8 is illustrated in FIG. 9. The unit of the number representing the length is millimeter.

Figure 10:
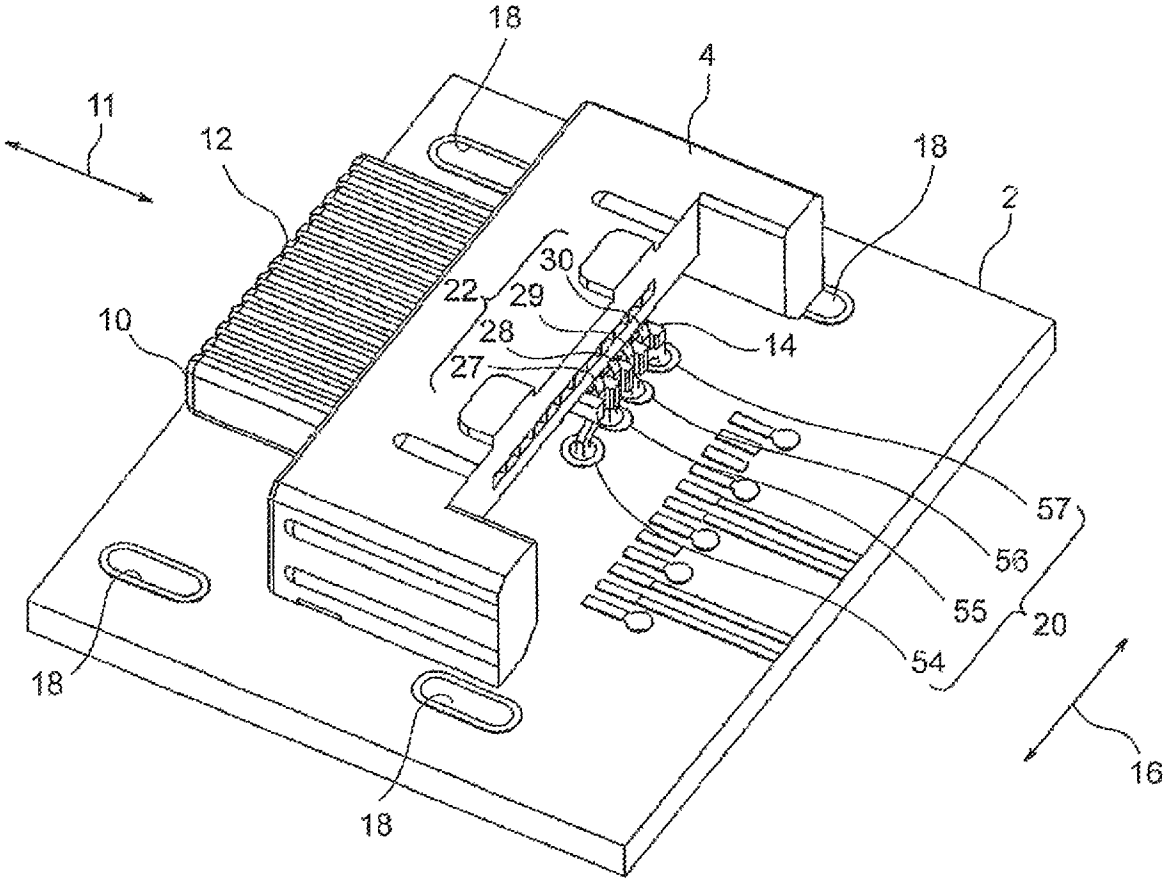
FIG. 10 is a perspective view for illustrating the housing 4, a lane 22, and the through hole row 20 when the connector 1 is mounted on the board 2.
Figure 11:
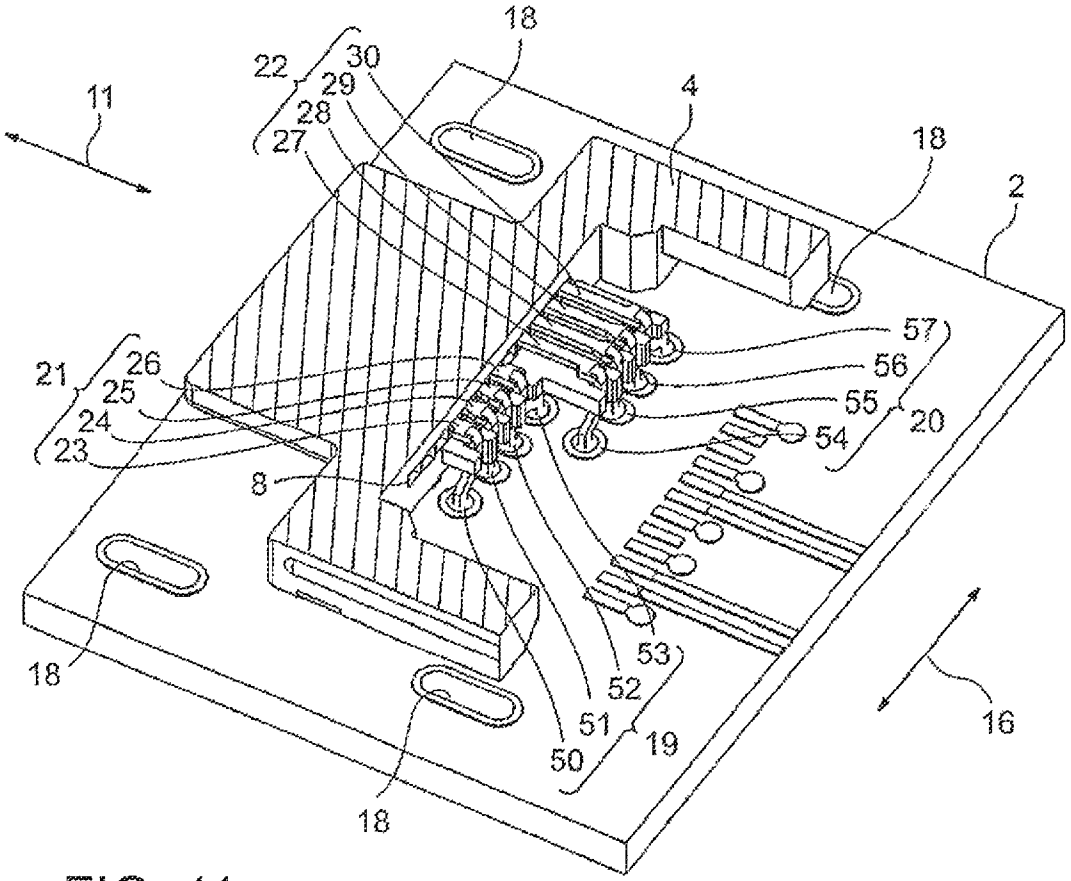
FIG. 11 is a partially-sectional perspective view obtained by cutting the housing 4 of FIG. 10 along a plane above an opening 8 so that the lane 21 and the through hole row 19 are visible.

The lanes 21 and 22 and the through hole rows 19 and 20 when the connector 1 is mounted on the board 2 are described. FIG. 10 is an illustration of a state when the connector 1 is mounted on the board 2 while omitting the shell 3 and the like so that the lane 22 and the through hole row 20 are visible. Further, FIG. 11 is an illustration of a state in which, in FIG. 10, the housing 4 is cut in a plane above the opening 8 (see FIG. 1) so that the lane 21 and the through hole row 19 are visible in addition to the lane 22 and the through hole row 20.

Now, the contact at the right end of the lane 21 and the contact at the left end of the lane 22 are focused. In the ground contact 26 of the lane 21, the second bent portion 26E is extended below the ground contact 27 of the lane 22, and then the board-side end portion 26F is inserted into the through hole 53. On the other hand, in the ground contact 27 of the lane 22, the second bent portion 27E exceeds the extension line of the ground contact 26 of the lane 21, and then the board-side end portion 27F is inserted into the through hole 54. Regarding the second bent portion and the board-side end portion, refer to the ground contact 23 of FIG. 5.

Figure 12:
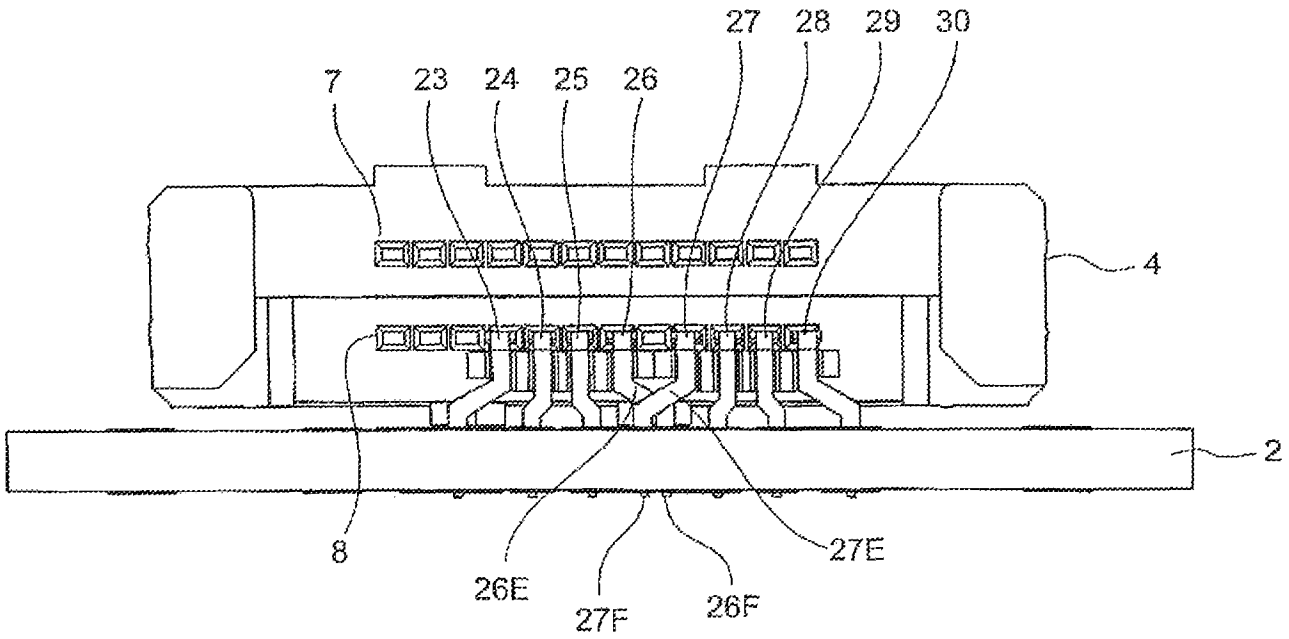
FIG. 12 is a view of the connector 1 of FIG. 10 as viewed from a side opposite to a counterpart connector (not shown) in a mounting/removing direction 11.

This positional relationship is clearly illustrated in FIG. 12. In the connector 1, the second bent portions of adjacent contacts that belong to different lanes are overlapped with each other so that the board-side end portion is inserted into the through hole formed below the counterpart lane or formed in a region on the extension of the counterpart lane. When the connector 1 is viewed along the mounting/removing direction 11 from the opposite side to the connection side with the counterpart connector, the second bent portion 26E of the ground contact 26 and the second bent portion 27E of the ground contact 27 intersect with each other. With such a configuration, the width of the entire through hole row of the connector 1 can be suppressed narrow.

Effect Relating to Transmission Characteristic

Figure 13:
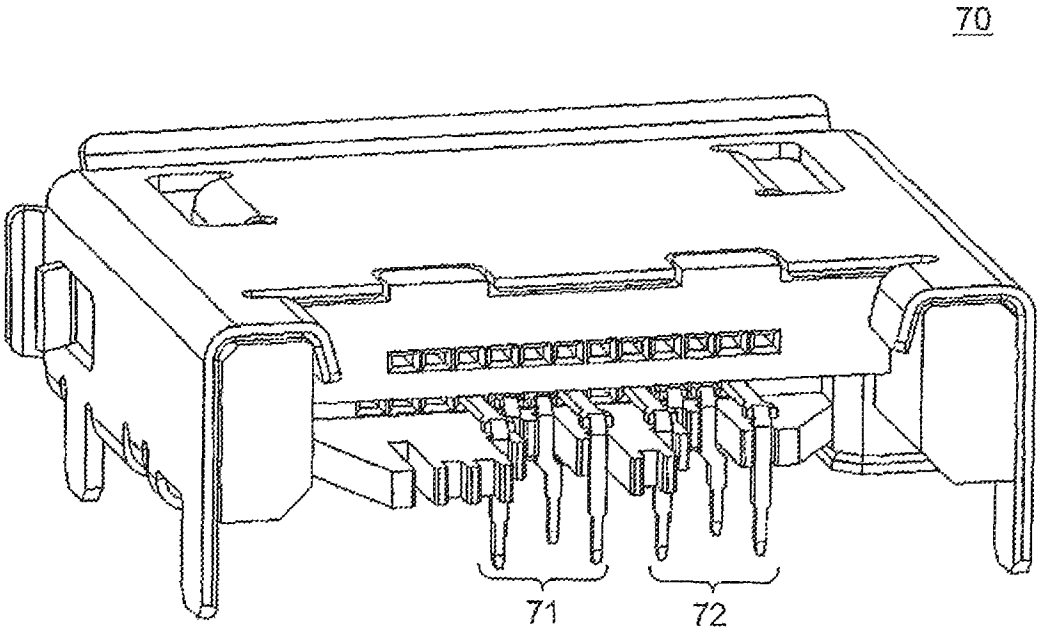
FIG. 13 is a perspective view of a connector 70 including contacts of Patent Document 1.
Figure 26:
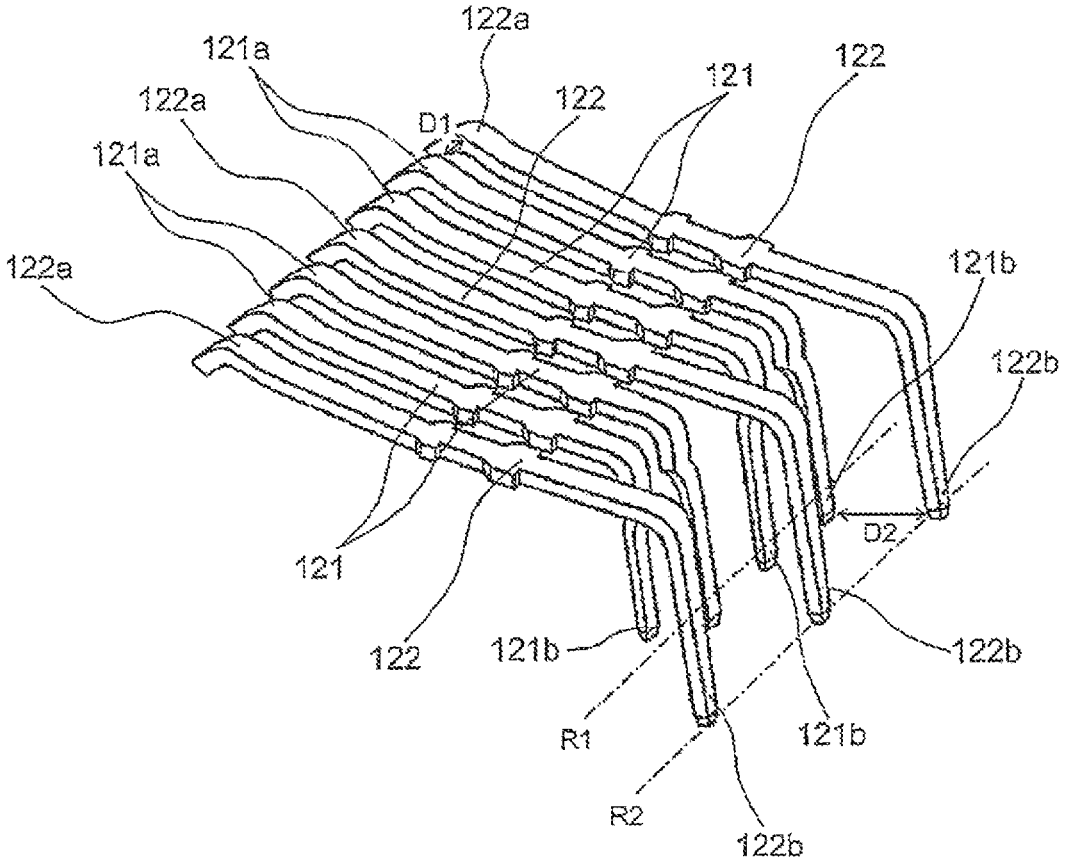
FIG. 26 is a view for illustrating contacts of a connector described in Patent Document 1.

The connector 1 of this invention is compared to the related-art connector. The target for comparison is a connector 70 as illustrated in FIG. 13. The connector 70 is a connector including contacts described with reference to FIG. 26 in the section of Background Art herein.

Figure 14:
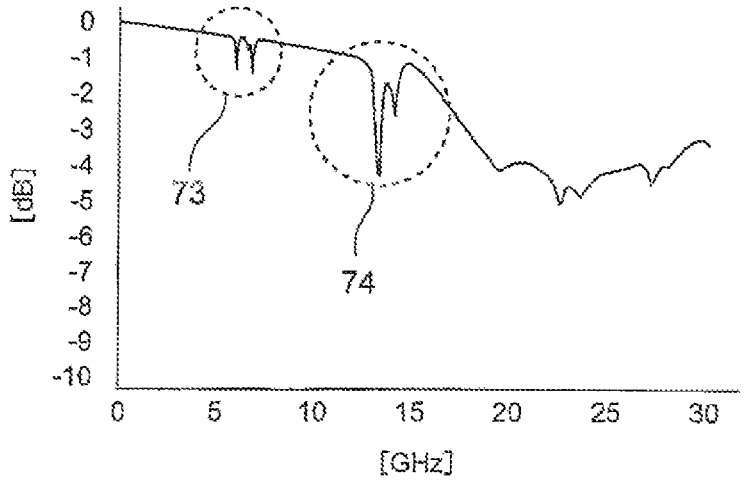
FIG. 14 is a schematic graph for showing a transmission characteristic of the connector 70.

The transmission characteristic of the connector 70, which has been simulated by the inventor of the present invention, is as shown in the graph of FIG. 14. As surrounded by the dotted lines 73 and 74, portions where the waveform abruptly falls (resonance points) are found. In particular, the resonance point 74 generated in a region of 10 GHz or more is large. The inventor of the present invention has found that this resonance point is a cause of the transmission failure that occurs when the connector 70 is used for signal transmission at a speed higher than that of the related art. In order to remove the resonance point that is the cause of the transmission failure, the inventor of the present invention has invented the connector 1 by employing a form in which the positional relationship between the two signal contacts and the two ground contacts is maintained as constant as possible.

The connector 1 and the connector 70 have the following differences as a result of comparison.

In the connector 1, the first bent portions of the contacts belonging to the same lane are located on one straight line, but in the connector 70, the bent portions of the ground contact and the signal contact are shifted.

In the connector 1, the pitches of the first linear portion and the second linear portion are the same, but in the connector 70, the pitches are different.

When the connector is viewed along the mounting/removing direction from the opposite side of the counterpart connector, in the connector 1, the contacts are inserted into the through holes such that parts of the adjacent contacts that belong to different lanes intersect with each other, but in the connector 70, such an intersection is not observed.

In the connector 1, the bending lines 31 and 32 of the first bent portions of the lanes 21 and 22 are located on two straight lines parallel to each other, and thus are different for each lane, but in the connector 70, each lane has a common straight line corresponding to the bending line of the first bent portion.

In the connector 1, not only the impedance matching between the signal contacts but also the impedance matching between the signal contact and the ground contact is achieved. In connector 70, however, the impedance matching between the signal contacts is achieved, but the impedance matching between the signal contact and the ground contact is not achieved.

Figure 15:
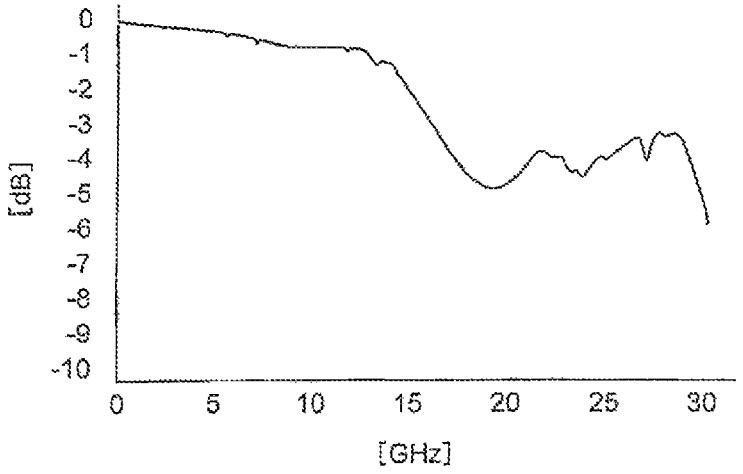
FIG. 15 is a schematic graph for showing a transmission characteristic of the connector 1.

The transmission characteristic of the connector 1 simulated by the inventor of the present invention is as shown in the graph of FIG. 15, in which the resonance points generated in the connector 70 are removed. As described above, in this invention, as compared to the related art, not only the impedance between the signal contacts but also the impedance between the signal contact and the ground contact is matched up to a higher frequency area. Therefore, the transmission failure in the high-speed signal transmission of 10 Gbps or more is suppressed.

Effect Relating to Crosstalks

In the connector 1, the pitch of the board-side end portions between, among the four contacts forming one lane, the two inner signal contacts is set to the minimum pitch length P2 defined based on the limitation in terms of solder mounting technology, and the pitch of the board-side end portions between the signal contact and the ground contact is set to the pitch length P3 that is larger than the pitch length P2. It has been found that setting different pitch lengths for the pitch between the signal contacts and the pitch between the signal contact and the ground contact as described above is effective in terms of suppressing crosstalks.

Figure 16:
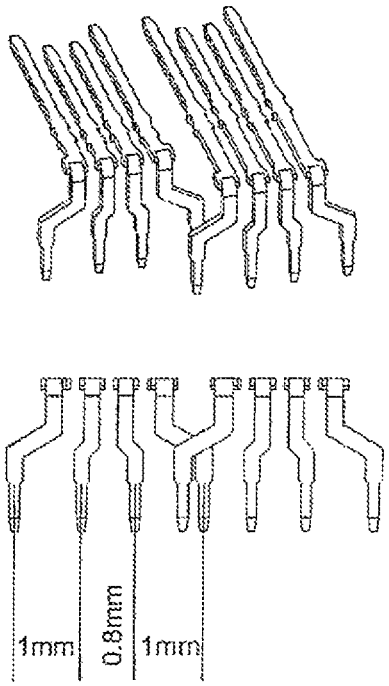
FIG. 16 is a view for illustrating pitch dimensions of board-side end portions of contacts used for comparison of a crosstalk characteristic.
Figure 17:
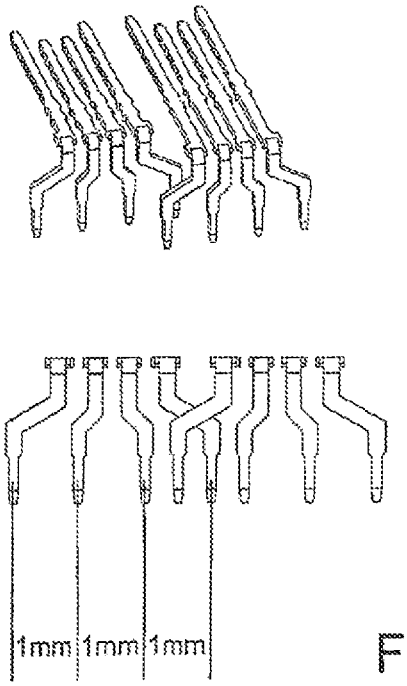
FIG. 17 is a view for illustrating pitch dimensions of board-side end portions of contacts used for comparison of the crosstalk characteristic.
Figure 18:
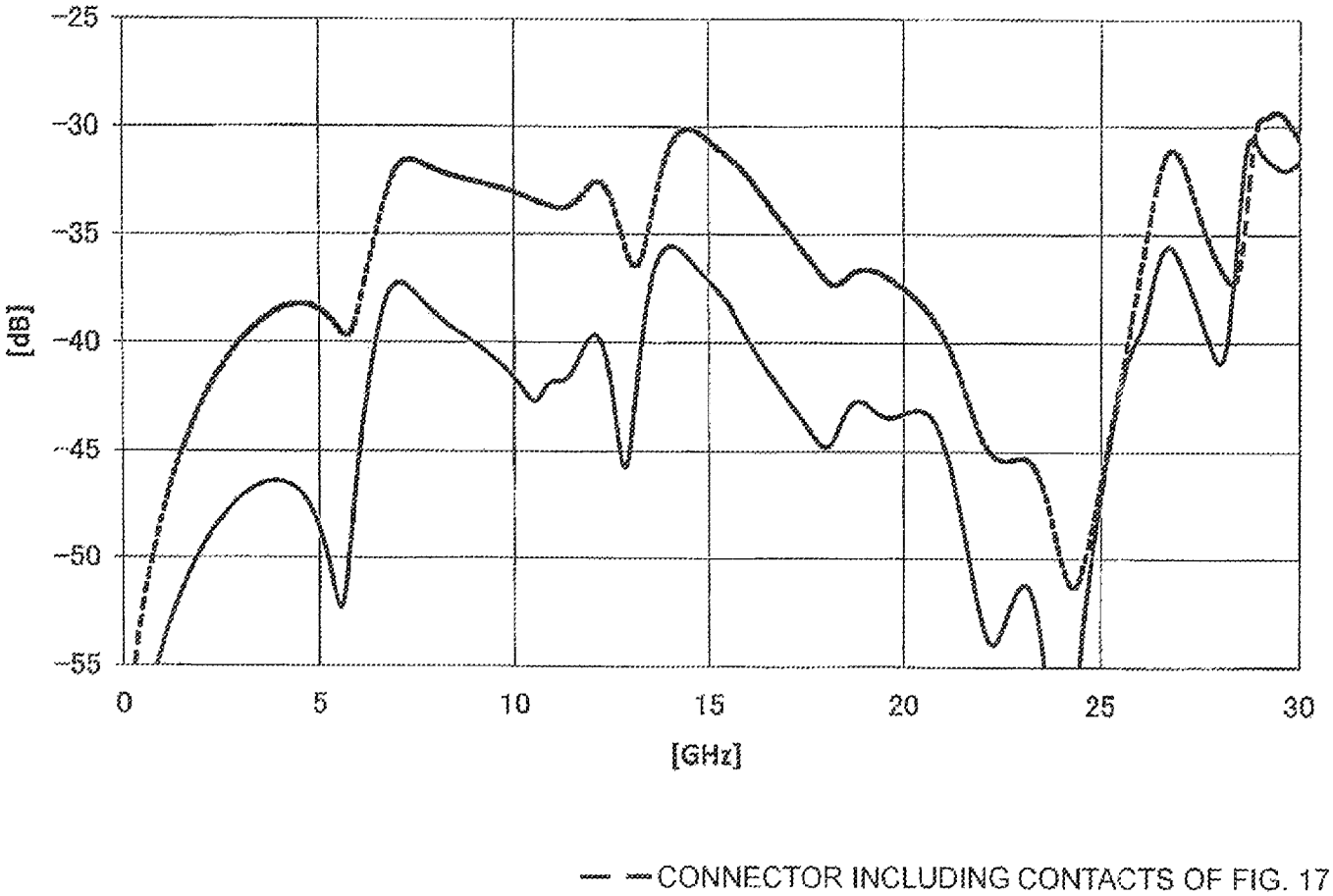
FIG. 18 is a schematic graph for comparing the crosstalk characteristic between a connector including the contacts of FIG. 16 and a connector including the contacts of FIG. 17.

Crosstalk characteristics are compared between the connector 1 including contacts in which, as illustrated in FIG. 16, the pitch length between the board-side end portions of the signal contacts is set to 0.8 mm, and the pitch length between the board-side end portions of the signal contact and the ground contact is set to 1 mm, and a connector formed so that, as illustrated in FIG. 17, while bending the contacts similarly to the contacts of the connector 1, the pitch of the board-side end portions is a constant value of 1 mm. In this case, the results are as shown in FIG. 18. As shown in FIG. 18, in substantially all frequency bands, the crosstalks are smaller in the connector including the contacts of FIG. 16.

Figure 19:
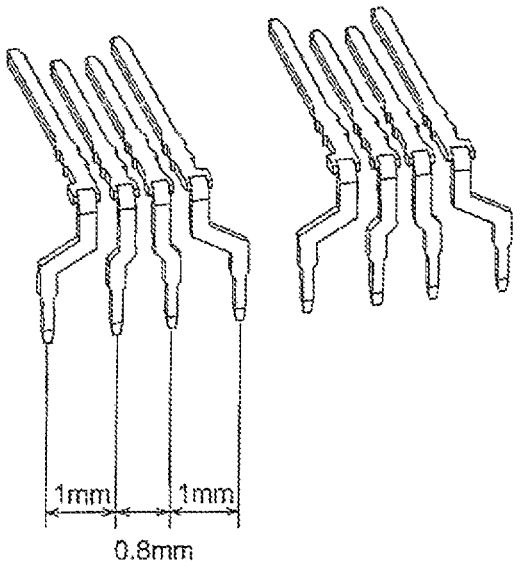
FIG. 19 is a view for illustrating pitch dimensions of board-side end portions of contacts used for comparison of the crosstalk characteristic.
Figure 20:
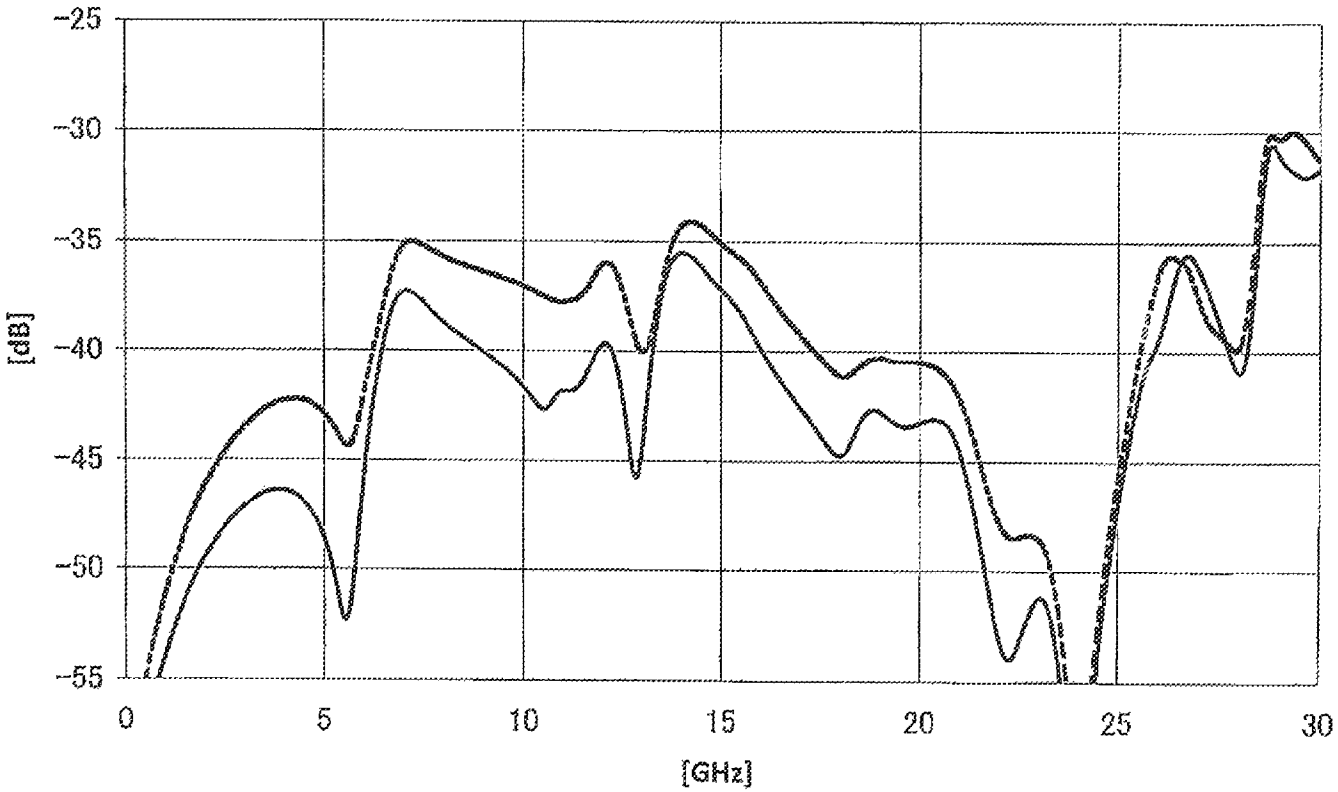
FIG. 20 is a schematic graph for comparing the crosstalk characteristic between the connector including the contacts of FIG. 16 and a connector including the contacts of FIG. 19.

Further, in the connector 1, the bending lines of the first bent portions are shifted between the lanes. This configuration is also effective in terms of reducing the crosstalks. The crosstalk characteristics are compared between the connector including the contacts in which, as illustrated in FIG. 16, the bending lines of the first bent portions are shifted between the lanes and a connector including contacts in which, as illustrated in FIG. 19, the common bending line of the first bent portion is used between the lanes. In this case, the results are as shown in FIG. 20. Note that, the contact of FIG. 19 is similar to the contact of FIG. 16 in that the pitch length between the signal contacts is 0.8 mm and the pitch length between the signal contact and the ground contact is 1 mm. As shown in FIG. 20, in substantially all frequency bands, the crosstalks are smaller in the connector including the contacts of FIG. 16.

This invention has been described above by means of embodiment, but this invention is not limited thereto, and it is needless to say that appropriate modification may be made thereto. Examples of the modification are given below.

Modification 1

In the above-mentioned connector 1, all contacts belong to any one of the lanes 21 and 22, but a contact not belonging to any of the lanes may be provided.

Figure 21:
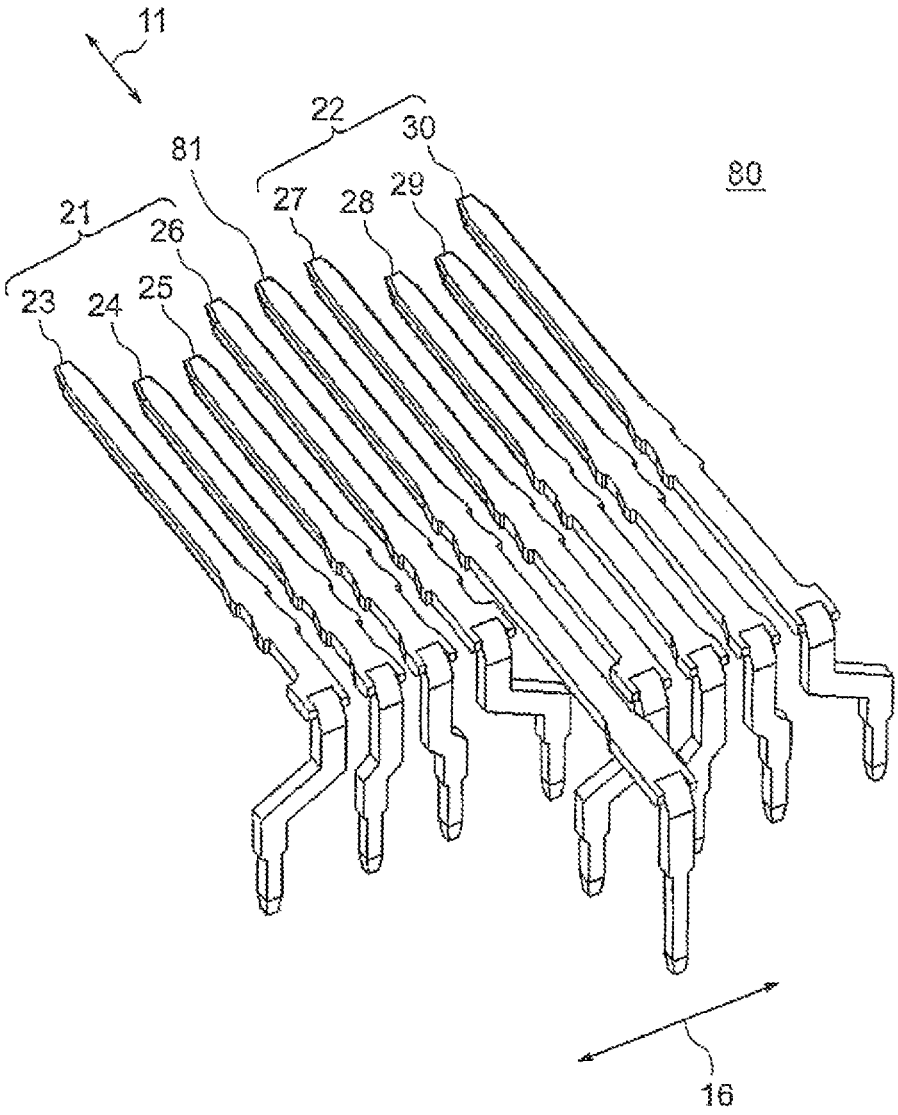
FIG. 21 is a perspective view for illustrating an out-of-lane contact 81 included in one modified example of the connector 1.
Figure 22:
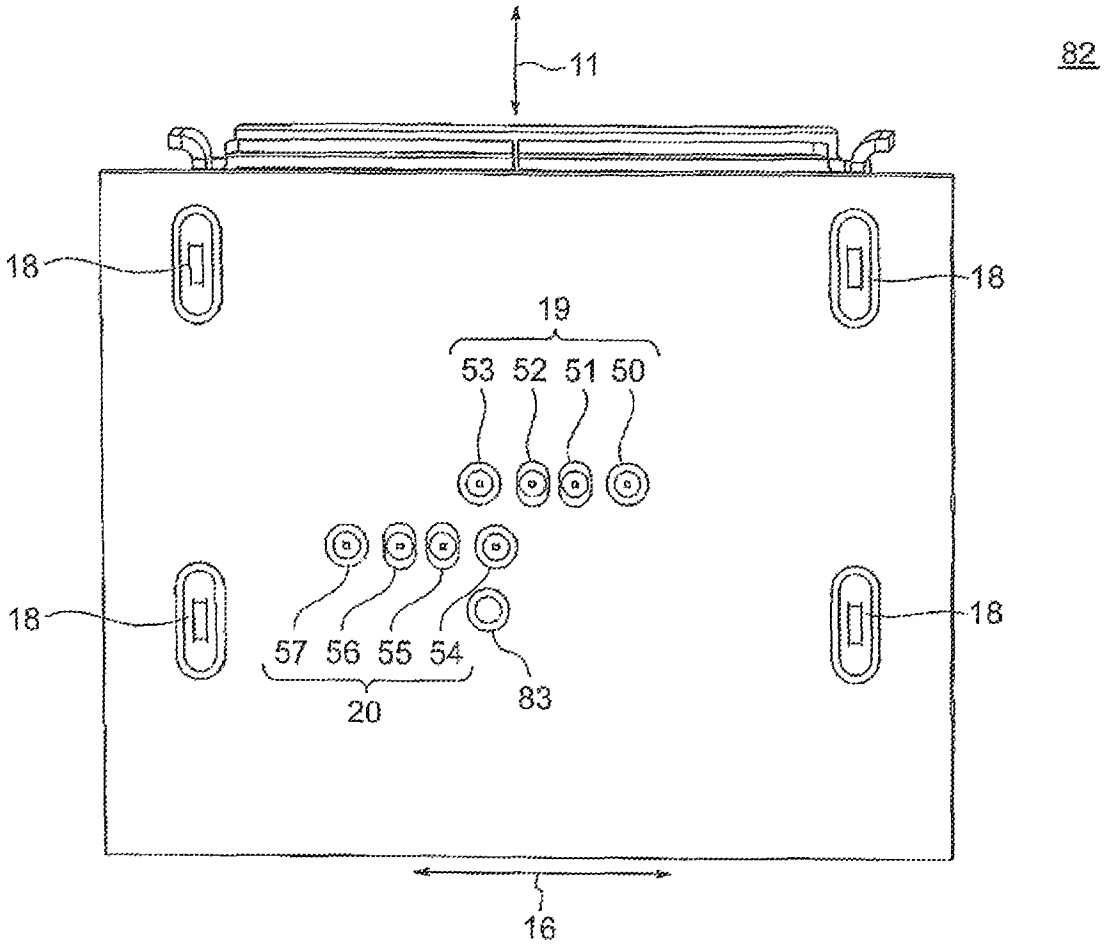
FIG. 22 is a view for illustrating a board 82 corresponding to a connector including the out-of-lane contact 81.
Figure 23:
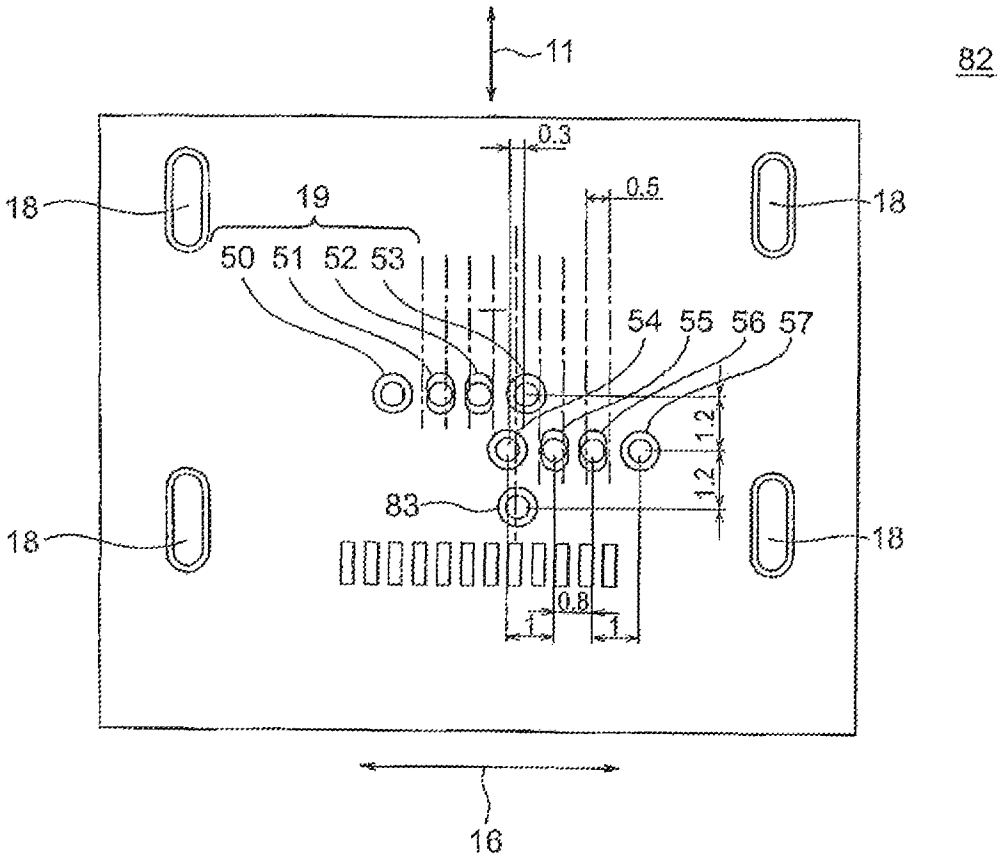
FIG. 23 is a view for illustrating a dimension example of the board 82.

A contact 80 illustrated in FIG. 21 is obtained by adding an out-of-lane contact 81 to the contact 5 illustrated in FIG. 4. In accordance therewith, a board 82 corresponding to the board 2 has a through hole 83. An example of the actual dimension of the board 82 is illustrated in FIG. 23. The unit of the number representing the dimension in FIG. 23 is millimeter.

Modification 2

Figure 24:
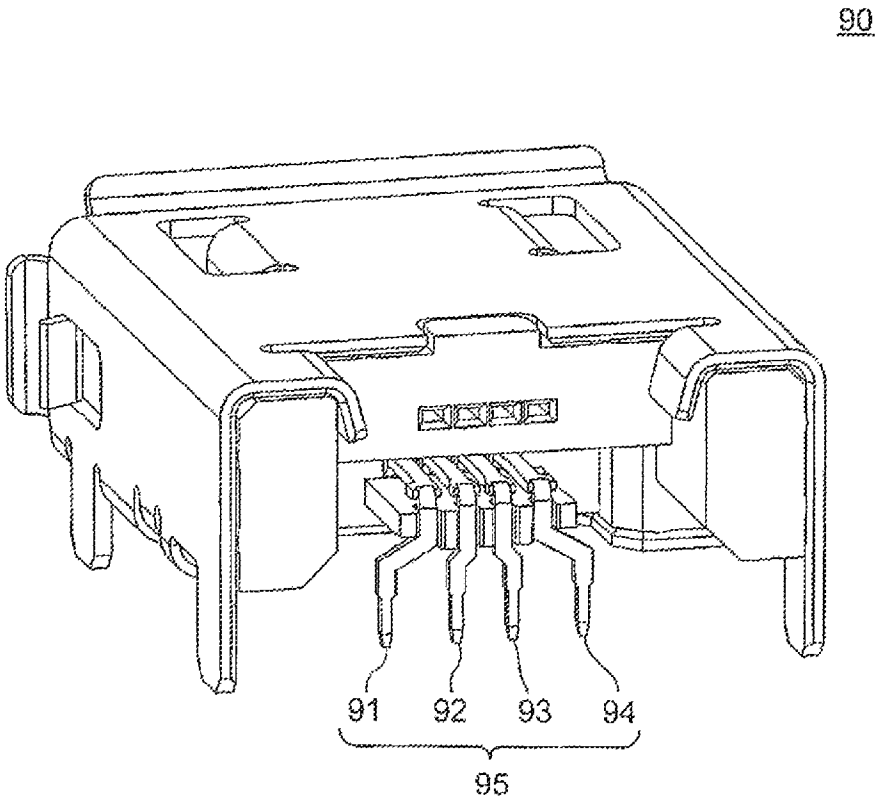
FIG. 24 is a perspective view of a connector 90 that is one modified example of the connector 1.

The connector 1 is a connector including two sets of lanes each including four contacts, but the connector of this invention is not limited to two sets of lanes. As in a connector 90 illustrated in FIG. 24, the connector of this invention may be a connector including one set of lanes 95 including a ground contact 91, signal contacts 92 and 93, and a ground contact 94.

Modification 3

Figure 25:
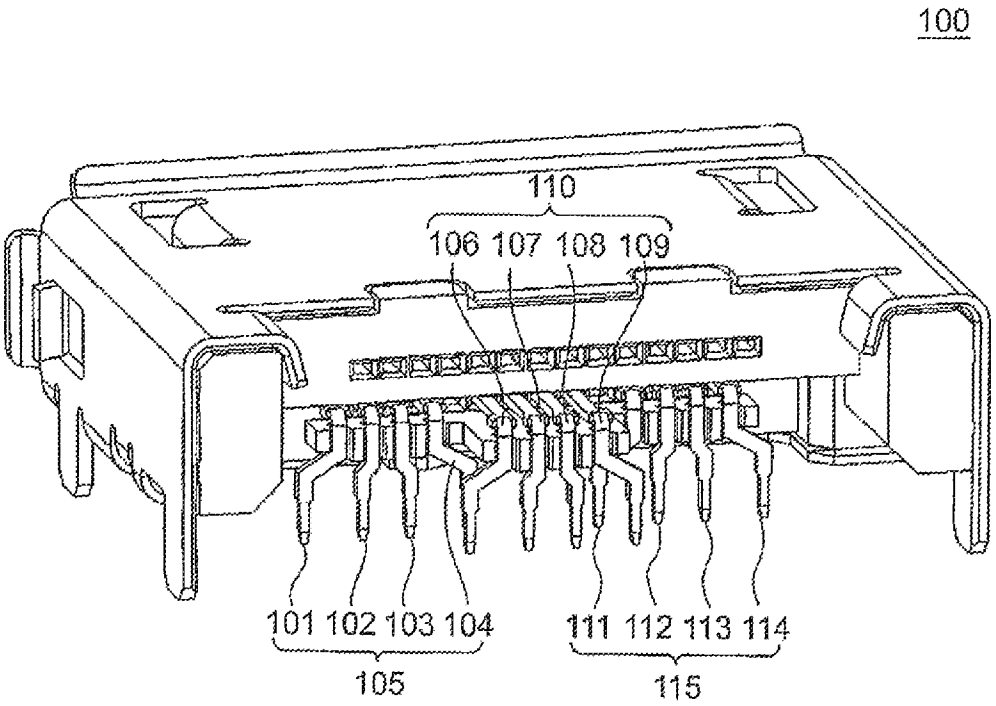
FIG. 25 is a perspective view of a connector 25 that is one modified example of the connector 1.

In contrast, the number of lanes may be increased. As in a connector 100 illustrated in FIG. 25, the connector may include three lanes, specifically, a lane 105 including a ground contact 101, signal contacts 102 and 103, and a ground contact 104, a lane 110 including a ground contact 106, signal contacts 107 and 108, and a ground contact 109, and a lane 115 including a ground contact 111, signal contacts 112 and 113, and a ground contact 114.

In the connector 100, the bending lines of the first bent portions of the lanes 105 and 115 are located on one straight line, and only the bending line of the first bent portions of the lane 110 is shifted. As described above, when three or more lanes are provided, by arranging the lanes in a staggered manner, the effect of reducing the crosstalks described referring to FIG. 20 can be obtained.

Modification 4

In the above-mentioned embodiment and Modifications 1 to 3, the connector in which one set of lanes includes four contacts is described as an example, but this invention is also applicable to a connector in which one set of lanes includes even number contacts of 6 or more. In this case, in the board-side end portions, the pitch between the two center contacts is set to the minimum pitch length. Under this state, the second bent portions of each contact may be bent so that the pitch having the minimum pitch length and the pitch having a predetermined pitch length larger than the minimum pitch length are secured alternately.

This application is based on and claims the benefit of priority from Japanese Patent Application No. 2013-232112, filed on Nov. 8, 2013, the disclosure of which is incorporated herein by reference in its entirety.

REFERENCE SIGNS LIST

1 connector
2 board
3 shell
4 housing
5, 6 contact
7, 8 opening
9 opening portion of shell
10 support plate
11 mounting/removing direction
12 upper groove
13 lower groove
14 support plate
15 board direction
16 width direction
17 leg portion
18 hole
19,20 through hole row
21, 22 lane
23, 26, 27, 30 ground contact
24, 25, 28, 29 signal contact
31, 32 bending line
33, 34 center line
40-48 pitch
50-57 through hole
80 contact
81 out-of-lane contact

The invention claimed is:

1. A connector, comprising:

at least one set of lanes each comprising a plurality of contacts including both of ground contacts and signal contacts forming a differential signal pair; and a support portion configured to support the plurality of contacts, the connector being configured to be fixed to a fixing object and removably mounted to a connection counterpart, the plurality of contacts forming the one set of lanes each comprising:

an end portion on the connection counterpart side;

a first linear portion supported by the support portion so as to be parallel to a first direction that is a mounting/removing direction with respect to the connection counterpart, and so that an equal pitch is secured between adjacent contacts;

a first bent portion obtained by bending, at a virtual straight line orthogonal to the first direction as a bending line, the plurality of contacts in a second direction different from the first direction;

a second linear portion extending in the second direction while maintaining the equal pitch;

a second bent portion obtained by bending at least a part of the plurality of contacts so as to increase a pitch between adjacent contacts; and an end portion on the fixing object side that is formed ahead of the increased pitch, the at least one set of lanes each comprising, as pairs of contacts adjacent to each other, both of a pair in which a pitch at the end portion on the fixing object side has a first pitch length and a pair in which the pitch at the end portion on the fixing object side has a second pitch length that is larger than the first pitch length.

2. A connector according to claim 1, wherein the one set of lanes comprises even number contacts of 4 or more, and wherein the contacts belonging to the one set of lanes are line symmetric with respect to, as an axis, a virtual straight line taken between the first linear portions of two center contacts, and are line symmetric with respect to, as an axis, a virtual straight line taken between the second linear portions, the second bent portions, and the end portions on the fixing object side of the two center contacts.

3. A connector according to claim 2, wherein, when four continuous and adjacent contacts belonging to the one set of lanes are sequentially referred to as Ca, Cb, Cc, and Cd, when a pitch of the end portions on the fixing object side between the contact Cb and the contact Cc is referred to as Pin, and when a pitch of the end portions on the fixing object side between the contact Ca and the contact Cb and a pitch of the end portions on the fixing object side between the contact Cc and the contact Cd are both referred to as Pout, the pitch Pin has the first pitch length, and the pitch Pout has the second pitch length.

4. A connector according to claim 1, wherein the equal pitch of the first linear portion is smaller than the first pitch length.

5. A connector according to claim 1, wherein the first pitch length is a minimum pitch defined based on a limitation in terms of solder mounting technology.

6. A connector according to claim 1, further comprising a contact independent from the one set of lanes, wherein the independent contact comprises at least the first linear portion and the first bent portion, and wherein the bending line of the first bent portion in the one set of lanes and the bending line of the first bent portion in the independent contact are located on two different straight lines that are parallel to each other.

7. A connector according to claim 1, wherein the at least one set of lanes comprises a plurality of lanes comprising a first lane and a second lane, wherein the support portion is configured to support the first lane and the second lane so as to be arrayed, and wherein the bending line of the first bent portion in the first lane and the bending line of the first bent portion in the second lane are located on two different straight lines that are parallel to each other.

8. A connector according to claim 7, wherein, as viewed from the first direction, the second bent portion of the first lane and the second bent portion of the second lane appear to be overlapped with each other at least in part, or appear to intersect with each other.

9. A connector according to claim 7, wherein the at least one set of lanes comprises a plurality of lanes comprising a first lane, a second lane, . . . , and an n-th lane, where n represents a natural number of 3 or more, wherein the support portion is configured to support the plurality of lanes so as to be arrayed, and wherein the bending line of the first bent portion in odd lanes comprising the first lane, the third lane, . . . , and the (2m−1)th lane, where m is a natural number, and the bending line of the first bent portion in even lanes comprising the second lane, the fourth lane, . . . , and the 2m-th lane, where m is a natural number, are located on two different straight lines that are parallel to each other.

10. A connector, comprising a plurality of contacts comprising both of ground contacts and signal contacts forming a differential signal pair, wherein impedance is matched between the ground contacts and the signal contacts.

11. A board on which the connector of claim 1 is to be mounted, the board comprising a plurality of through holes configured to insert therein contacts belonging to the one set of lanes, wherein a pitch between the plurality of through holes comprises at least the first pitch length and the second pitch length.

12. A board according to claim 11, wherein two of the plurality of through holes having the first pitch length comprise oval lands.

13. A signal transmission method, comprising mounting the connector of claim 1 to a fixing object to transmit differential signals.

* * * * *